US009751088B2

(12) United States Patent
Held et al.

(10) Patent No.: US 9,751,088 B2
(45) Date of Patent: Sep. 5, 2017

(54) METHOD FOR OPERATING A MILL

(75) Inventors: Harald Held, Haar (DE); Michael Metzger, Markt Schwaben (DE); Florian Steinke, München (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 1329 days.

(21) Appl. No.: 13/635,572

(22) PCT Filed: Mar. 8, 2011

(86) PCT No.: PCT/EP2011/053414

§ 371 (c)(1),
(2), (4) Date: Sep. 17, 2012

(87) PCT Pub. No.: WO2011/117060

PCT Pub. Date: Sep. 29, 2011

(65) Prior Publication Data

US 2013/0008985 A1 Jan. 10, 2013

(30) Foreign Application Priority Data

Mar. 24, 2010 (DE) ..... 10 2010 012 620

(51) Int. Cl.
*B02C 17/24* (2006.01)
*B02C 17/18* (2006.01)
*B02C 25/00* (2006.01)

(52) U.S. Cl.
CPC ..... *B02C 17/24* (2013.01); *B02C 17/1805* (2013.01); *B02C 25/00* (2013.01)

(58) Field of Classification Search
CPC ..... B02C 25/00; B02C 17/24; B02C 17/1805
(Continued)

(56) References Cited

U.S. PATENT DOCUMENTS 3,181,800 A 5/1965 Bertil et al. ..... 241/24.1
4,212,429 A 7/1980 Cuvelier ..... 241/26
(Continued)

FOREIGN PATENT DOCUMENTS

CA 2794026 A2 9/2011 ..... B02C 17/18
CH 640751 A 1/1984 ..... B02C 17/16
(Continued)

OTHER PUBLICATIONS

International Search Report and Written Opinion, Application No. PCT/EP2011/053414, 11 pages, Mar. 21, 2013.
(Continued)

*Primary Examiner* — Matthew G Katcoff
(74) *Attorney, Agent, or Firm* — Slayden Grubert Beard PLLC

(57) ABSTRACT

The rotational speed of the drum of an ore mill may be controlled variably over time. By rotating the drum during a first time interval at high speed, especially hard or dense particles are broken up by tumbling. At the same time, the discharge characteristics of the mill are adversely affected. In a subsequent second time interval, the drum is rotated at a slower speed, and the material is discharged more effectively, whereas the tumbling movement inside the mill is not achieved. The combination of said different modes of operation within short time periods in continuous operation may improve both the comminution as a result of a tumbling motion of the material and also the discharge of the ground material. By regulating the rotational speed with different target values within short time windows, different requirements for the movement behavior of the material to be ground and for the discharge characteristics of the ground material can be simultaneously optimized. This may allow a higher throughput for the mill.

8 Claims, 4 Drawing Sheets

(58) Field of Classification Search
USPC ..... 241/35, 36
See application file for complete search history.

(56) References Cited

U.S. PATENT DOCUMENTS

| | | | | |
|---|---|---|---|---|
| 5,215,263 | A | 6/1993 | Getzmann | 241/30 |
| 5,570,846 | A | 11/1996 | Stehr | 241/21 |
| 7,017,841 | B2 * | 3/2006 | Tirschler | B02C 17/1805 241/30 |
| 7,566,017 | B2 | 7/2009 | Latchireddi | 241/183 |
| 8,366,029 | B2 | 2/2013 | Becker et al. | 241/30 |
| 2008/0035771 | A1 | 2/2008 | Thome | 241/101.2 |
| 2010/0230519 | A1 | 9/2010 | Torres et al. | 241/25 |
| 2010/0237175 | A1 | 9/2010 | Becker et al. | 241/30 |

FOREIGN PATENT DOCUMENTS

| | | | | |
|---|---|---|---|---|
| DE | 2811490 | A1 | 9/1978 | B02C 17/18 |
| DE | 3920273 | A1 | 1/1991 | B02C 17/16 |
| DE | 102006019417 | A1 | 11/2007 | B02C 25/00 |
| DE | 102006038014 | B3 | 4/2008 | B02C 17/18 |
| EP | 0700724 | A1 | 3/1996 | B02C 17/16 |
| GB | 1596559 | A * | 8/1981 | B02C 17/1805 |
| RU | 68360 | U1 | 11/2007 | B02C 13/14 |
| SU | 961777 | A1 | 9/1982 | B02C 25/00 |
| WO | 2008/122689 | A1 | 2/2008 | B02C 17/08 |
| WO | 2011/117060 | A2 | 9/2011 | B02C 17/18 |
| WO | 2009/156585 | A1 | 4/2012 | F02M 51/06 |

OTHER PUBLICATIONS

Rajamani, Raj K. et al., "Optimal Control of a Ball Mill Grinding Circuit—I. Grinding Circuit Modeling and Dynamic Simulation," Chemical Engineering Science, vol. 46, No. 3, 10 pages, Jun. 29, 1990.

Apelt, T.A., "Inferential Measurement Models for Semi-Autogenous Grinding Mills," Ph.D. Thesis, Department of Chemical Engineering, University of Sydney, 364 pages, May 2, 2007.

German Search Report, Application No. 10 2010 012 620.9, 2 pages, Mar. 17, 2011.

Peruvian Office Action, Application No. 001622-2012/DIN, 7 pages, Jun. 6, 2016.

Chilean Office Action, Application No. 2392-2012, 5 pages, Jun. 9, 2016.

Argentinian Office Action, Application No. P110100977, 6 pages, dated May 23, 2017.

* cited by examiner

METHOD FOR OPERATING A MILL

CROSS-REFERENCE TO RELATED APPLICATIONS

This application is a U.S. National Stage Application of International Application No. PCT/EP2011/053414 filed Mar. 8, 2011, which designates the United States of America, and claims priority to DE Patent Application No. 10 2010 012 620.9 filed Mar. 24, 2010. The contents of which are hereby incorporated by reference in their entirety.

TECHNICAL FIELD

This disclosure relates to mills, such as for example tube mills, ball mills or SAG mills (semi-autogenous grinding mills), which are suitable for milling coarse grained materials such as for example ores or cement. The milling and comminution/pulverizing of ore is an important step in the mining industry. For this purpose, use is mostly made of SAG mills and ball mills. In both cases, these are tube mills or drum mills, a simplified view of which is that they comprise a rotating cylinder (drum) which is filled with the ore to be milled. By the rotation of the drum the material to be milled is moved upward in the mill, and it then falls down onto further material which is still on the floor of the mill. The impact of the ore particles together with the friction within the circulating charge leads to the ore being broken up. In order to improve the efficiency of the milling, in many milling systems steel balls are added in additionally with the material in the mill.

BACKGROUND

In the case of the mills cited, their throughput is controlled by means of adjustments to various manipulated and reference variables, such as for example the rotation rate or rotational speed of the drum, the feeding of the coarse grained ore, a water feed and/or the speed of discharge of the milled material present at the outlet. An important quality attribute here is the distribution of grain sizes in the milled material. This affects the yield from other components downstream from the mill, such as for example a flotation facility. The objective is to achieve as high a throughput as possible with high product quality and low costs. The energy and/or material requirements make a major contribution to the last of these.

Today's mills are adjusted manually by the operating staff on the basis of empirical values from their experience. Many drum mills, in particular of older designs, can only be operated at a single rotational speed or rotation rate, which is laid down back at the development stage of the mill. In this case, the rotation rate cannot be controlled. In contrast, newer mills, such as for example mills with a direct drive or gearless drive, as applicable, have an ability for their rotation rate to be adjusted to any required set value over a wide range.

There are known control units for mills which select an optimal rotation rate for the mill and hold this constant during the operation of the mill. Here, the rotation rate can be adjusted beforehand for the different types of ore or other operating conditions which are relevant for the mill. A rotation rate regulator for a tube mill is known from DE 10 2006 038 014 B3.

A known way of improving the discharge characteristics is to output the material not in the middle but at the wall of the mill. Mills which do this are referred to as screening drum mills. However, screening drum mills are not suitable for processing ores, because suitably robust sieves can only be constructed with difficulty. A known alternative is to construct the lifter plates differently. In this case, the typical straight-line radial lifter plates are replaced by curved or even more complex 2-chamber structures, as known from U.S. Pat. No. 7,566,017 B2.

An adaptive model predictive regulation for a tube mill is known from DE 10 2006 019 417 A1.

SUMMARY

In one embodiment, a method for operating is provided, in which a drive for a mill shell, which is mounted on bearings so that it can turn, is actuated with the assistance of a rotation rate regulator, and in which the rotation rate of the mill shell is regulated at differing set values which change during the ongoing operation of the mill.

In a further embodiment, the mill is a tube mill, in particular an ore mill, ball mill and/or a SAG mill and the mill shell is a drum. In a further embodiment, the rotation rate of the drum is regulated alternately with a first set value for the rotation rate and a second set value for the rotation rate. In a further embodiment, the first set value for the rotation rate is selected so as to optimize the breaking up of large and/or dense particles in a material which is to be milled, and the second set value for the rotation rate is selected so as to optimize the breaking up of smaller particles in the material which is to be milled, and/or the discharge characteristics of the mill. In a further embodiment, the first set value for the rotation rate is selected to be about 90% of a critical rotation rate and the second set value for the rotation rate to be about 60% of the critical rotation rate. In a further embodiment, the rotation rate of the drum is regulated to the first set value for the rotation rate and the second set value for the rotation rate, in each case for less than 60 minutes. In a further embodiment, the rotation rate of the drum is regulated to a set value for the rotation rate which is continuously varying. In a further embodiment, the mill is arranged as a central mill in a milling system, an adaptive overall model of the mill is determined with account being continuously taken of measured values, and the continuously varying set value for the rotation rate is adjusted with the assistance of an adaptive model predictive regulator which comprises a control unit and which accesses the adaptive overall model. In a further embodiment, the ongoing operation of the mill is a continuous mode or a batch mode.

In another embodiment, a computer readable data medium is provided, on which is stored a computer program which, when it is processed on a computer, executes any of the methods disclosed above. In another embodiment, a computer program is executed by a computer to carry out any of the methods disclosed above. In another embodiment, a control unit is provided, which is equipped for performing any of the methods disclosed above.

BRIEF DESCRIPTION OF THE DRAWINGS

Example embodiments will be explained in more detail below with reference to figures, in which.

DETAILED DESCRIPTION

Figure 1:
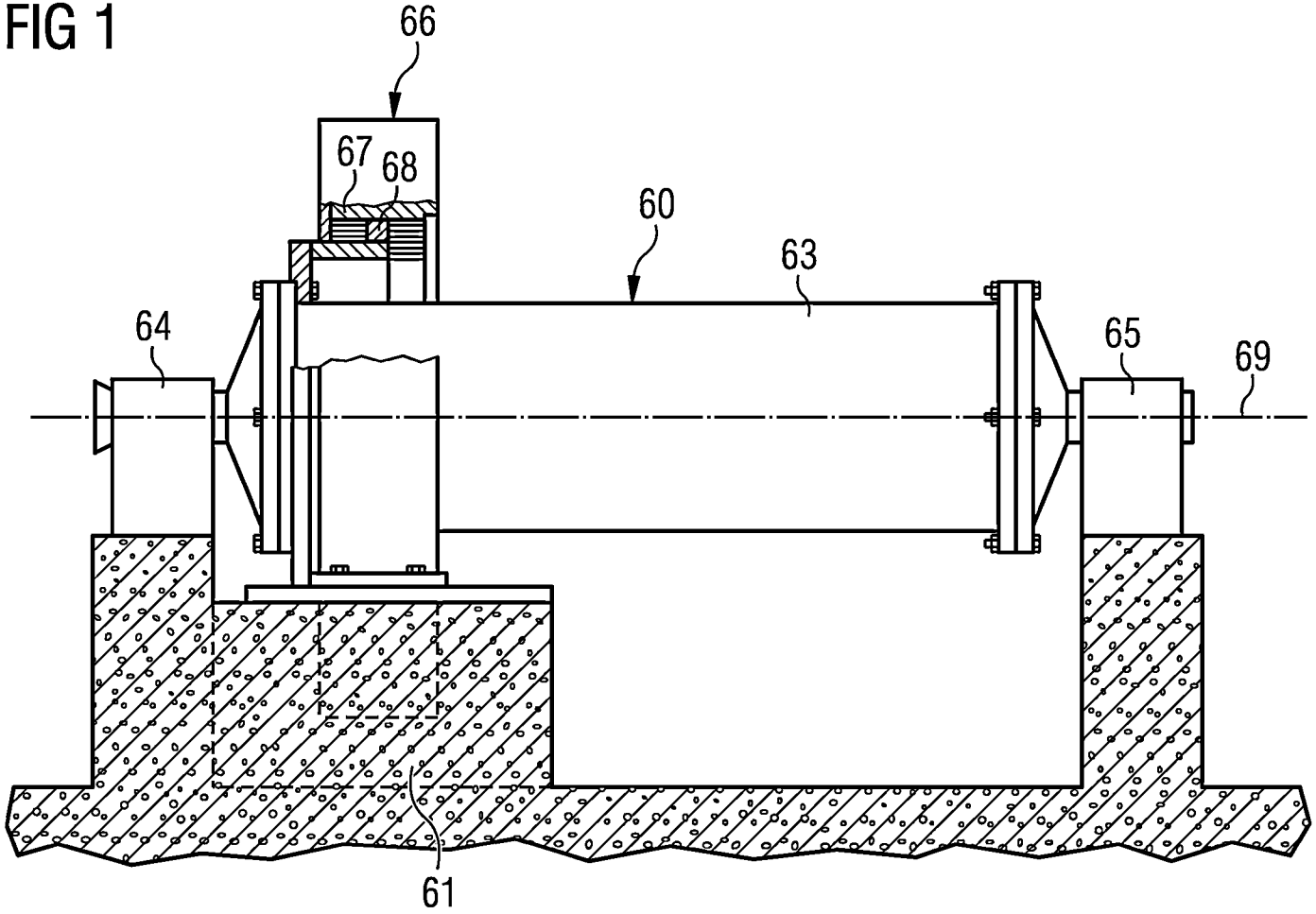
FIG. 1 illustrates the principle of the construction of a tube mill.

Some embodiments improve or optimize the quality and discharge of the milled material.

More specifically, some embodiments provide a drive for a mill shell, which is mounted on bearings so that it can turn, and which is actuated with the help of a rotation rate regulator. The rotation rate of the mill shell is regulated to different set values, which change during ongoing operation of the mill.

This makes it possible to select for the mill shell an optimal rotational speed which varies over time. This makes it possible to optimize both the movement characteristics within the mill of the material which is to be milled and also the discharge from the mill of the milled material.

In accordance with one development, the mill is a tube mill, in particular an ore mill such as a ball mill or SAG mill, and the mill shell is a drum.

In an additional development, the rotation rate of the drum is regulated alternately with a first set value for the rotation rate and a second set value for the rotation rate. Here, the first set value for the rotation rate is selected so as to optimize the size reduction of large and/or dense particles in a material which is to be milled. The second set value for the rotation rate is selected so as to optimize the size reduction of smaller particles in the material which is to be milled and/or the discharge characteristics of the mill. The first set value for the rotation rate may be selected as about 90% of a critical rotation rate and the second set value for the rotation rate as about 60% of the critical rotation rate, where the critical rotation rate specifies a value at which the outermost layer of the ore is already being centrifuged.

The speed of rotation or the rotation rate of the drum may thereby be controlled variably over time. In that the drum is rotated during a first time interval at a higher speed, especially hard or dense particles are broken up by tumbling. At the same time, during the first time interval the discharge characteristics of the mill are detrimentally affected.

Following on from the first time interval is a second time interval, in which the drum is rotated at a lower speed. In the second time interval, the material is more effectively output, while the tumbling movement within the mill cannot be achieved. On average, the combination of these different types of operation within short time intervals in ongoing operation improves both the breaking up of the material by a tumbling movement and also the discharge of the milled material.

In an additional development, the rotation rate of the drum is regulated at the first rotation rate set point and the second rotation rate set point in each case for less than 60 minutes. The time intervals during which the rotation rate of the drum is regulated in each case at the first rotation rate set point or the second rotation rate set point can be, for example, one, two, five, ten, twenty, thirty or forty minutes.

By regulating the rotation rate to different set points within short time windows, it is possible to optimize at the same time the different requirements for the movement characteristics of the material to be milled and the discharge characteristics of the material which has been milled.

This has the advantage that it is possible to achieve a higher throughput for the mill. At the same time, a favorable factor is that it is not necessary to take into account the energy requirement for accelerating and braking at the transition between set values for the rotation rate, because the mill must in any case be driven continuously, because energy losses due to the internal friction in the charge and from the energy required to break the particles are continuously braking the drum. This means that it is possible to achieve braking of the mill simply in that its active acceleration is from time to time discontinued. Hence, a change in rotation rate requires no additional expenditures or energy costs. This means as a consequence that all the energy which is released by braking the mill is fed directly into the material which is to be milled, and so is not lost.

An important practical consideration is the question of how the time intervals and the associated rotation rates should be chosen to ensure both the maximum throughput and minimum energy consumption. For this purpose, the mill is arranged as a central mill in a milling system. An adaptive overall model is determined for the mill, with measured values being continuously taken into account. The rotation rate of the drum is regulated using a set value for the rotation rate which is continually varied. This continually varied set value for the rotation rate is adjusted with the help of an adaptive model predictive regulator which comprises a control unit and which accesses the adaptive overall model.

In this development, the mill is modeled dynamically. For this purpose, a dynamic state-space model is developed, which specifies the current content of the mill, the energy consumption of the mill, together with the current breakage rate of coarse particles into finer categories. Examples of such models are to be found in Rajamani, R. K.; Herbst, J., "Optimal Control of a Ball Mill Grinding Circuit. Pt. 1: Grinding Circuit Modeling and Dynamic Simulation", Chemical Engineering Science, 46(3), 861-70, 1991 and in Apelt, T. A., "Inferential Measurement Models for Semi-autogenous Grinding Mills", PhD Thesis, 2007. Dynamic models permit predictions as to how changes, in the rotation rate or the speed at which the material to be milled is fed into the mill, affect the overall system (in particular the breakage rate, the energy consumption and the discharge characteristics of the mill). Hence, these models are ideally suited for undertaking a quantitative optimization of the time intervals and the speeds. In addition, they make it possible to calculate rotation rate trajectories instead of fixed set values for each time interval.

Apart from the method just described, some embodiments provide a computer-readable data medium, on which is stored a computer program which, when it is processed on a computer, carries out any of the methods described herein.

Other embodiments provide a computer program which is processed on a computer and when this is done it carries out any of the methods described herein.

FIG. 1 shows the principle of the construction of a mill 60, in this case a tube mill, which is arranged on a foundation 61. Here, the horizontally arranged drum 63 is mounted in bearings 64 and 65, and turns about an axis of rotation 69. Associated with the mill shell 63 there is in addition a drive 66 in the form of a ring motor. The rotor 67 of the ring motor is arranged on a flanged ring 68 on the mill shell 63. Adjacent to the rotor 67 is a stator, which is not shown in FIG. 1.

Figure 2:
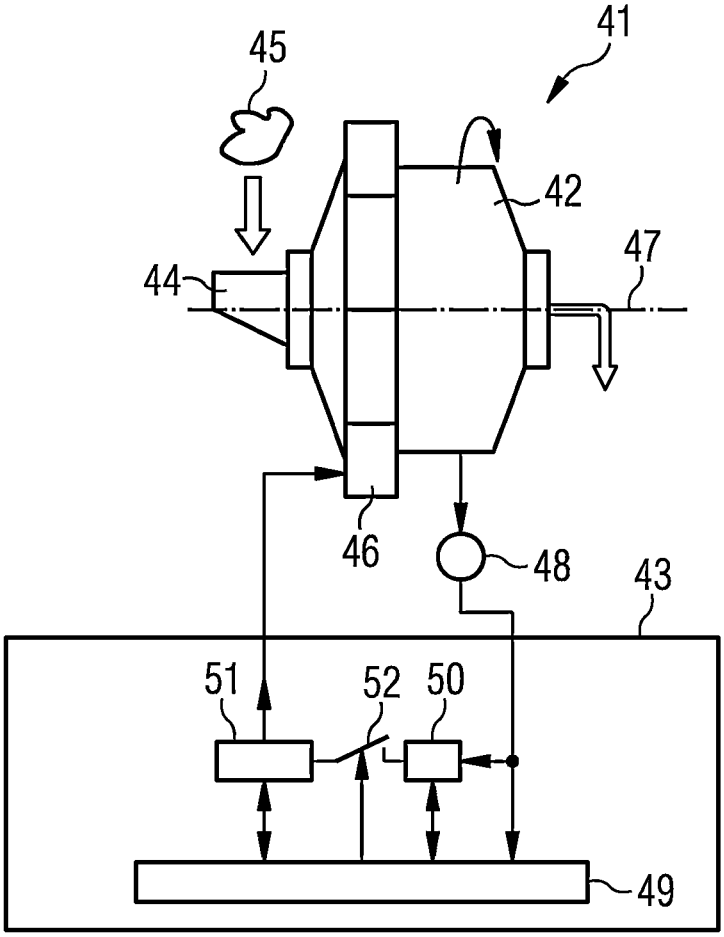
FIG. 2 illustrates a mill with a charged drum which can be driven in rotation about an axis of rotation, and with a control unit.

FIG. 2 shows a schematic representation of a mill 41 with a drum 42 and a control unit 43. The mill 41 is an ore mill, which is constructed as a ball mill or a SAG mill. The drum 42 is connected to a feed shaft 44 by means of which the ore to be milled 45 passes into the interior of the drum 42. For the purpose of breaking up the ore 45, the charged drum 42 can be driven in rotation about an axis of rotation 47 by means of a drive 46, constructed for example in the form of a gearless electric motor.

A rotation rate sensor 48, for sensing the rotation rate of the drum 42 is provided on the drum 42. The rotation rate sensor 48 is connected to the control system 43. The latter incorporates, in particular, at least one central computational unit 49, for example in the form of a microcomputer, microprocessor or microcontroller module, a rotation rate regulator 50 connected to the rotation rate sensor 48 and a drive regulator 51 connected to the drive 46. The rotation rate regulator 50 and the drive regulator 51 are connected to each other by means of a switch 52. The rotation rate sensor 50, the drive regulator 51 and the switch 52 are connected to the central computational unit 49.

The rotation rate regulator 50, the drive regulator 51 and also the switch 52 can be physically existing modules, for example electronic ones, or on the other hand can be software modules stored in a memory, which is not shown in more detail, which are executed in the central computational unit 49 after they have been called up. The individual components 49 to 51 cited interoperate with other components and/or units which are not shown in FIG. 2 on grounds of clarity. Apart from this, the control unit 43 can be constructed in the form of a single unit or as a combination of several separate sub-units.

The choice of an optimal set value for the rotation rate depends mainly on the composition of the ore to be milled and on the desired characteristics of the discharge. For this reason, several factors must be considered in selecting the set value.

The rotation rate of the drum 42 has an effect on the movement characteristics of the ore 45 within the mill 41. At a low rotation rate, the ore 45 forms a coagulated mass ("bundling"), i.e. the majority of the ore 45 is stirred around by the rotation, whereby ore particles are reduced in size by abrasion and shearing forces. At higher rates of rotation, the ore 45 begins to fall down in the drum 42 as in a waterfall ("tumbling"), i.e. the ore particles fly freely through the drum 42 and then hit against its walls or against ore particles remaining in front of the wall, whereby the ore particles are broken up by the impact. At intermediate rotation rates, both of these scenarios can be present at the same time. At particularly high rates of rotation, the ore 45 is centrifuged, i.e. is pressed against the drum wall, with the result that the individual ore particles do not break up any more. The bundling and the tumbling movement characteristics of the ore 45 each has specific advantages in relation to the size reduction, where these advantages depend on the nature of the ore to be milled.

In principle, most types of ore require at least a certain proportion of tumbling motion in the drum 42, so that larger and dense ore particles are broken up. For this reason, it is often desirable to rotate the drum 42 at a relatively high rate of rotation, to ensure a tumbling movement of the ore 45 within the drum 42. Typically, the drive is at rotation rates above 80% of a critical rotation rate, where this critical rotation rate specifies a value at which the outermost layer of the ore 45 is already being centrifuged. In the recent past, even higher rotation rates have been used for the size reduction and grinding.

However, the rotation rate of the drum 42 also has a significant influence on the discharge characteristics of the mill 41. Discharge from the mill 41 takes place roughly as follows: smaller ore particles which have been broken up together with water, which is also fed into the mill 41, form a slurry or sludge which then flows through a sieve within the mill 41 into an output compartment, the so-called sludge lift. There, the sludge is lifted up by the rotation of the drum 42, with radially arranged lifter plates, which are built into the discharge compartment, contributing to this effect. At the vertically highest point, the sludge falls into a centrally arranged hole, the typical exit from a drum 42. If use is made of this mechanism, which is typically used in drum mills, a certain basic speed is required in order to lift the sludge appropriately. However, excessive rotation rates are problematic, because in this case the centrifugal force balances the gravitational force, and prevents discharge. Above a certain rotational speed, the particles no longer fall into the centrally located hole, because they are pressed against the walls of the drum 42, and are therefore no longer output. Both analytical calculations and practical experience show that this effect becomes a problem for rotation rates of more than 75% of a critical rotation rate (at which the ore 45 begins to centrifuge). Experiments with a trial mill have shown correspondingly that a higher rotational speed has a positive effect on the breaking rate together with a strong negative effect on the discharge characteristics.

Because the requirements to be met by the discharge characteristics of the mill 41 limit the maximum speed of rotation, it is not always possible to fully utilize the desired tumbling movement of the ore 45 within the mill 41, with the high speeds this requires.

In a first exemplary embodiment, the mill 41 is, for example driven for about five minutes at 90% of the critical rotation rate, whereby large lumps in the ore 45 are well reduced in size. Following this, the mill 41 is driven for five minutes at 60% of the critical rotation rate, because at this rotation rate smaller pieces in the ore 45 are better crushed, and the discharge characteristics of the mill 41 are more favorable. The operation of the mill 41 in this case is uninterrupted, and can be continued with changing rotation rates in accordance with the pattern described for as long as desired.

By the use of a suitable control unit 43, it is possible to compute continuously varying, optimized speed/time paths or rotation rates. Today's mill drives are often capable of driving at speeds which vary over time.

In accordance with a second exemplary embodiment, the mill 41 is operated in batch mode. In this case, the drum 42 is initially rotated at a high rotation rate, by which means large lumps in the ore 45 are shattered. After this, other particles in the ore 45 are crushed at a lower rotation rate. Finally, the fine material is discharged.

Figure 3:
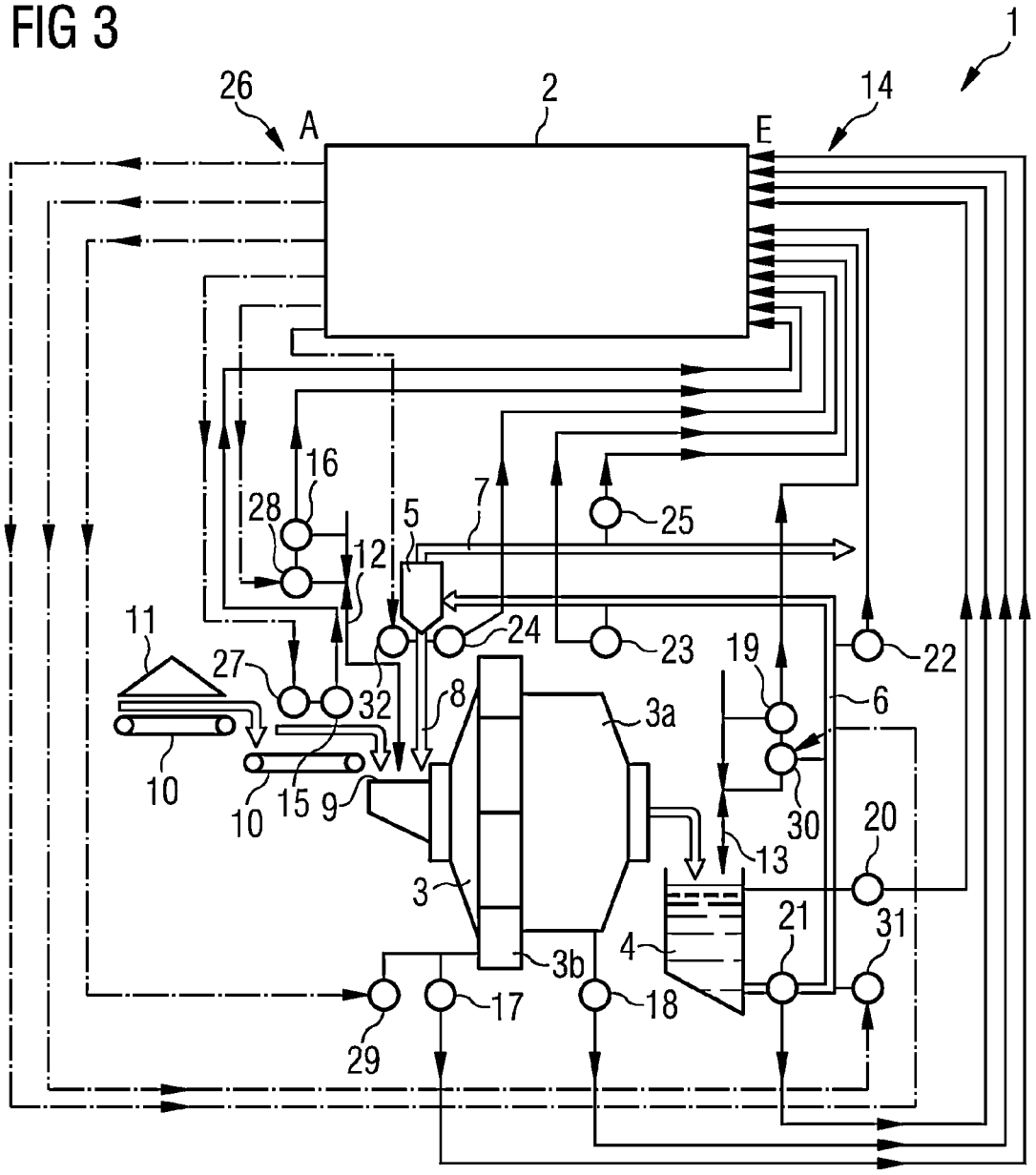
FIG. 3 illustrates a milling system with an adaptive model predictive control system.

FIG. 3 shows a milling system 1. The milling system 1 incorporates an ore mill, which is constructed as a ball mill or as a SAG mill. It is connected to an adaptive model predictive control unit 2, which controls the operation of the milling system 1.

As its main components, the milling system 1 incorporates a central mill 3 with a drum 3*a*, for grinding the ore which is fed in, and a drive 3*b*, in particular a gearless one, which drives the drum 3*a*, a sump unit 4 which is fed from the central mill 3, and a hydrocyclonic unit 5. The sump unit 4 and the hydrocyclonic unit 5 are connected to each other by means of a hydrocyclone feed pipe 6. In the hydrocyclonic unit 5, a separation takes place into material which is finely enough ground and material which is still too coarse-grained. On the output side, the finely ground material passes into an outflow pipe 7 which is connected to a component, not shown in more detail here, which is downstream from the milling system 1. On the other hand, the coarse-grained material is fed via a return flow pipe 8 back to a feed shaft 9 on the central mill 3.

The feed shaft 9 is in addition connected to conveyor belts 10, by means of which unground ore is fed in from an ore stock 11. Instead of the conveyor belts 10, another feed unit can also be provided. Furthermore, the feed shaft 9 is connected to a water inlet 12. Another water inlet 13 is provided on the sump unit 4.

The milling system 1 contains in addition a plurality of measuring sensors which sense measured values for various operating variables B and feed them to the control unit 2 by means of instrument leads 14. For example, a weighscale 15 is provided on the conveyor belts 10, a flow meter 16 in the water inlet 12, a power and torque meter 17 on the drive 3*b*, a weighscale 18 for sensing the loading of the drum 3*a*, a flow meter 19 in the water inlet 13, a level meter 20 on the sump unit 4, a grain size meter 21, a flow meter 22 and a pressure meter 23 each on the hydrocyclone feed line 6, a densimeter 24 in the return flow line 8 and a grain size meter 25 on the outflow line 7. This list is to be considered simply as an example. In principle yet more measuring sensors can be provided. Each of the measurements is always made online and in real time, so that current measured values are always available in the control system 2.

Apart from the measuring sensors, the milling system 1 also has several local regulators, which are connected to the control system 2 by means of control lines 26. In detail, a weight regulator 27 is provided on the conveyor belts 10, a flow regulator 28 on the water inlet 12, a rotation rate regulator 29 on the drive 3*b*, a flow regulator 30 on the water inlet 13 and on the hydrocyclone feed line 6, a level regulator 31 on the sump unit 4 and a density regulator 32 on the return flow line 8.

The measuring sensors and local regulators mentioned are to be understood as only by way of example. In an individual case, further components of this type can also be provided. For example, on the conveyor belts 10 additional information about the nature of the unmilled ore which is being fed in may be obtained, for example by means of a laser measurement or by means of video sensing. Equally however, it is also possible to restrict the measuring sensors and local regulators to only some of those shown in FIG. 3.

Apart from this, further operating variables, which are not susceptible to a direct measurement, can be determined by means of so-called soft sensors. Here, use is made of primary operating variables which can be sensed, from the measured values of which a current value for the secondary operating variables which are actually of interest is determined by means of an evaluation algorithm. The evaluation software used for this purpose can also include a neural network.

In the control unit 2, settings are determined for the various process parameters of the milling system 1 such that a good uniform throughput results, with the lowest possible energy consumption and highest possible product quality. A high product quality means a particular, relatively limited, grain size for the milled material fed into the discharge line 7 on the output side.

In accordance with a third exemplary embodiment, one of the process parameters of the milling system 1 controlled by the control unit 2 is the rotation rate of the drum 3*a*.

A further consideration which must be taken into account in practice is that the variable rotation rate leads, as applicable, to fluctuations in the production rate or a discharge flow from the central mill 3 which varies over time. However, downstream processes such as a flotation facility may require a constant product feed. When there is variable rotation rate control, it is thus necessary to choose a larger capacity for the sump unit 4 which is downstream from the central mill 3. However, corresponding changes are only necessary to a limited extent, because the variable rotation rate control can be applied at short intervals of time, so that fluctuations in the production rate will even after a short time be averaged out.

Figure 4:
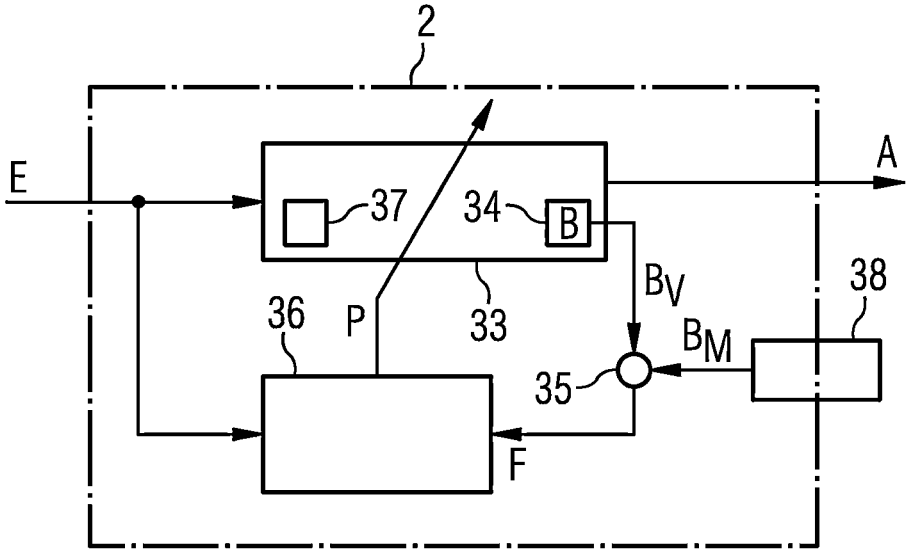
FIG. 4 illustrates a block diagram of the control system shown in FIG. 3.

FIG. 4 shows a block diagram of the control unit 2 with its main components. It incorporates an adaptive overall model 33 of the milling system 1, a prediction unit 34, a comparison unit 35, a parameter identification and adaptation unit 36 together with an optimization unit 37. These components, in particular, are realized as software modules.

The block diagram shown in FIG. 4 contains one measuring unit 38, which stands for the plurality of measuring sensors represented in the figure. In the case of an embodiment as a soft sensor, even the measuring unit 38 can be realized as a software module, and hence as an integral component of the control unit 2. Otherwise, however, it is equally possible that the measuring unit 38 is physically separate modules from the control unit 2.

The way in which the control unit 2 functions is described below in more detail.

On the input side, various input variables E are fed to the control unit 2. These can be measured values, but could also be other items of operating data. Possible input data items E are the weight of the ore, the hardness of the ore to be milled, the water inflow to the water inlets 12 and 13, the return flow of material from the hydrocyclonic unit 5 to the input 9 on the central mill 3, grain size distribution at various points within the milling system 1, in particular in the sump unit 4 or in the discharge line 7 on the output side, geometry data for the central mill 3, the speed at which the conveyor belts 10 feed the material to be milled to the input 9, and the speed at which the end product, that is the milled material, is fed on to the following components. The input variables E can thus relate to process parameters, to the design of the milling system 1, above all the central mill 3, or to the material.

On the output side, the control unit 2 makes available output variables A which are used for controlling the progress of the process. In a first variant these are reference variables for the various local regulators shown in FIG. 3. In a second variant, the control unit 2 makes available on its output side manipulated variables which affect actuators directly, that is without the interposition of local regulators.

In accordance with a fourth exemplary embodiment, one of the output variables A is used, in accordance with one of the two variants, for the purpose of regulating the rotation rate of the mill drum.

The adaptive overall model 33 describes the milling system 1 in its entirety. In the fourth exemplary embodiment, it is made up of a linkage of several sub-models. These sub-models describe the central mill 3, the sump unit 4 and the hydrocyclonic unit 5. These can be supplemented by further sub-models for other components of the milling system 1, as required. The adaptive overall model 33 can be adapted by means of model parameters P to the process conditions which currently prevail, in doing which the parameter identification and adaptation unit 36 also determines whether this adaptation is to be effected by means of all the model parameters P, or only some of them. Thus, if necessary, a relevant subset of the model parameters P will be identified. The model parameters P thus selected are then particularly well suited for the adaptation of the model.

In the fourth exemplary embodiment, the adaptive overall model 33 is based on physical stipulations which, at least partly, can also be supplemented by empirical values from experience. The adaptive overall model 33, and in particular its adaptation by means of the model parameters P, is calculated in real time. This contributes to the fact that no lags worth mentioning arise in the regulation.

On the basis of the current adaptive overall model 33, i.e. the one which applies for a particular operating phase, a predicted value $B_v$ is determined in the prediction unit 34 for one or more operating variable(s) B. In the comparison unit 35, this predicted value $B_v$ is compared with a measured value $B_M$ of the operating variable B concerned. Any deviation F which is detected is made available to the parameter identification and adaptation unit 36, for the determination of an improved set of model parameters P. The settings for the model parameters P, improved in this way, are then referred to in adapting the adaptive overall model 33. The adapted overall model 33 is then used for determining the output variables A and also the predicted value $B_v$ for a future operating phase.

Because the control unit 2 is then using as a basis a forecast of the value which the operating variable B will have in future, regulation lags are largely eliminated. The control unit 2 is thus on the one hand very stable, and on the other hand reacts very rapidly to changes in the process conditions.

It is possible to imagine various variables of the milling system 1 as the operating variable B, such as for example a through flow, a density, a weight, a pressure, a power, a torque, a speed, a granularity or even a distribution of grain sizes. These are, in particular, some of the input variables E. It is the grain size distribution above all which is particularly well suited for the determination of an improved parameter set for the model parameters P.

In the parameter identification and adaptation unit 36, use is made of a mathematical optimization method, such as for example sequential quadratic programming (SQP), by which a predefinable objective function is minimized subject to boundary conditions, and is used for the determination of the improved parameter (sub-)set for the model parameters P. In the parameter identification and adaptation unit 36, the objective function minimization, and hence the parameter adaptation, is undertaken in such a way that the adapted overall model 33 represents as well as possible the past behavior of the milling system 1. A value $B_R$ for the operating variable B in a preceding operating phase (=for at least one preceding cycle) calculated using the overall model 33, adapted in this way, would deviate minimally from the measured value $B_M$ which was sensed. With this adapted parameter set, the adapted overall model 33 describes optimally the reality in the past.

Consideration could be given, for example, to using the deviation between the measured and calculated grain size distribution as the objective function. Possible boundary conditions are then derived, in particular, from a transition matrix, the coefficients of which specify the probability that a material particle, which in the current cycle falls within a particular sub-range in the grain size distribution, will after the next cycle fall within a (different) particular sub-range in the grain size distribution. The values which the coefficients of this transition matrix can assume are subject to certain mathematically or physically determined restrictions. It is possible to set limits on the individual coefficients, but also on combinations, for example for the sums of several coefficients.

Equally, it is also possible to define as the objective function the deviation between measured and calculated densities in the return flow line 8. Obviously, it is also possible to make use of a combination of several objective functions for the purpose of the optimization in the parameter identification and adaptation unit 36.

The adapted overall model 33 obtained by reference to the observations of the past is then used in a further method step for the purpose of regulation, in particular of the rotation rate of the drum 3*a*, in future i.e. in the coming cycle. This is effected in the optimization unit 37. Here too, an objective variable is optimized subject to the adherence to boundary conditions. The objective is now, in particular, to achieve a optimal determination of the output variables A, that is in particular the value set for the rotation rate, so that for example a prescribed grain size distribution is achieved at a particular point in the milling system 3, in particular at the exit. For this second optimization, the objective variable can then be, in particular, the product quality. As boundary conditions, consideration will be given to the material requirement and the energy requirement.

Other conceivable boundary conditions are the result of the physical, technological or process-based limits. These can advantageously be directly included in the inputs to the optimization algorithm, so that a set of manipulated or reference variables which would lead to an unstable running of the process is excluded ab initio.

It may, for example, be demanded by a boundary condition, determined on the basis of process economics that the density in the return flow line 8 does not exceed eighty percent, because otherwise the separation efficiency in the hydrocyclonic unit 5 drops significantly due to changes in the rheology. In addition, the rotation rate of the drum 3*a* may be restricted in order to avoid too strong centrifugal forces. In the same way there are maximum and minimum values for the pump powers in the fresh water feed, and also in the case of the feed of unmilled ore. Apart from this, limits must be observed for the maximum loading state of the drum 3*a*.

The observance of boundary conditions also contributes to the operating mode, which is set for the milling system 1, satisfying several requirements to the same extent. For example, it is possible in this way to optimize the mill speed, the fresh water feed into the central mill 3 and into the sump unit 4 together with the energy consumption, while at the same time keeping the throughput and the product quality achieved at a prescribed level.

In accordance with a first variant, the value set for the rotation rate is different from one operating phase to another, but within each operating phase is held constant.

In accordance with a second variant, the value set for the rotation rate is varied continuously, even within the individual operating phases, with the result that the rotation speed of the drum 3*a* changes constantly. For this purpose, a temporal course is calculated for the rotation rate such that the objective variable(s) is(are) optimized.

The above expositions have been based on the example of an ore mill. However, the principles described and advantageous ways of working can also be simply transferred to the operation of other types of mill, such as for example cement mills or the mills used in the pharmaceutical industry.

What is claimed is:

1. A method for operating a mill, comprising:

operating a drive for a mill shell using a rotation rate regulator, the mill shell containing a material to be milled, and the drive being rotatably mounted on bearings, and during an ongoing operation of the mill, automatically regulating the rotation rate of the mill shell between at least a first set value and a second set value for the rotation rate in a step-wise manner for a respective first set duration and a respective second set duration.

2. The method of claim 1, wherein the mill comprises one of an ore mill, a ball mill, and a SAG mill, and wherein the mill shell is a drum.

3. The method of claim 1, wherein the first set value for the rotation rate is selected to optimize breaking up of large or dense particles in the material to be milled, and wherein the second set value for the rotation rate is selected to optimize at least one of (a) breaking up of smaller particles in the material to be milled and (b) discharge characteristics of the mill.

4. The method of claim 3, wherein the selected first set value for the rotation rate is about 90% of a critical rotation rate, and the selected second set value for the rotation rate is about 60% of the critical rotation rate.

5. The method of claim 1, wherein the rotation rate of the drum is regulated based on each of the first and second set values for the rotation rate for less than 60 minutes for each of the first and second set values for the rotation rate.

6. The method of claim 2, wherein the rotation rate of the drum is regulated to a set value for the rotation rate that varies continuously.

7. The method of claim 6, wherein the mill is arranged as a central mill in a milling system, wherein an adaptive overall model of the mill is dynamically determined based on continuously measured values, and wherein the continuously varying set value for the rotation rate is adjusted using an adaptive model predictive regulator based on the adaptive overall model.

8. The method of claim 1, wherein the ongoing operation of the mill comprises a continuous mode or a batch mode.

* * * * *